US008717161B1

(12) United States Patent
Gary

(10) Patent No.: US 8,717,161 B1
(45) Date of Patent: May 6, 2014

(54) LOCKOUT FOR HYDROGEN SULFIDE MONITORING SYSTEM

(71) Applicant: Crook W. Gary, Midland, TX (US)

(72) Inventor: Crook W. Gary, Midland, TX (US)

( * ) Notice: Subject to any disclaimer, the term of this patent is extended or adjusted under 35 U.S.C. 154(b) by 50 days.

(21) Appl. No.: 13/682,354

(22) Filed: Nov. 20, 2012

Related U.S. Application Data

(60) Provisional application No. 61/562,086, filed on Nov. 21, 2011.

(51) Int. Cl.
*G08B 23/00* (2006.01)

(52) U.S. Cl.
USPC ..... 340/501; 340/531; 340/632; 340/539.22; 73/23.2; 702/24

(58) Field of Classification Search
USPC ..... 340/501, 632, 531, 539.1, 539.18, 340/539.22, 539.26, 633, 634; 73/23.2, 73/23.4; 702/24
See application file for complete search history.

(56) References Cited

U.S. PATENT DOCUMENTS 4,157,283 A 6/1979 Zetter
4,231,249 A * 11/1980 Zuckerman ..... 73/31.03
5,311,197 A 5/1994 Sorden et al.
5,382,943 A 1/1995 Tanaka
5,454,918 A 10/1995 Javadi et al.
5,568,121 A 10/1996 Lamensdorf
5,650,770 A 7/1997 Schlager et al.
5,867,105 A 2/1999 Hajel
5,969,623 A 10/1999 Fleury et al.
6,079,490 A 6/2000 Newman
6,252,510 B1 6/2001 Dungan
6,404,884 B1 6/2002 Marwell et al.
6,606,897 B1 8/2003 Koyano et al.
6,670,887 B2 12/2003 Dungan
6,701,772 B2 3/2004 Kreichauf et al.
6,744,373 B2 6/2004 Koyano et al.
6,785,619 B1 8/2004 Homann et al.
6,794,991 B2 9/2004 Dungan
6,856,253 B1 * 2/2005 Crook ..... 340/632
6,954,143 B2 * 10/2005 Crook ..... 340/539.26
7,212,111 B2 5/2007 Tupler et
7,463,160 B2 * 12/2008 Crook ..... 340/632
8,400,317 B2 * 3/2013 Johnson et al. ..... 340/632
8,446,274 B1 * 5/2013 Crook ..... 340/539.11
2004/0056771 A1 3/2004 Dungan

* cited by examiner

*Primary Examiner* — Toan N Pham
(74) *Attorney, Agent, or Firm* — www.bobharter.com; Robert J. Harter

(57) ABSTRACT

An H2S (hydrogen sulfide) system includes a lockout configuration that temporarily disables wireless communication while leaving one or more H2S sensors and audible alarms still functioning in case an H2S hazardous event occurs during the lockout period. Example H2S systems and methods include various means for initiating or ensuring the lockout configuration is in effect.

18 Claims, 5 Drawing Sheets

LOCKOUT FOR HYDROGEN SULFIDE MONITORING SYSTEM

CROSS REFERENCE TO RELATED APPLICATIONS

This application claims the benefit of provisional patent application Ser. No. 61/562,086 filed on Nov. 21, 2011 by the present inventor.

FIELD OF THE DISCLOSURE

The subject invention generally pertains to monitoring of H2S gas of an environment and more specifically to wireless communication of an H2S monitoring system.

BACKGROUND

At some worksites, it may be important to monitor the concentration H2S gas (hydrogen sulfide gas) and sound an alarm to alert workers in the area if the concentration reaches a hazardous level. Some worksites are provided with a local monitor connected in wireless communication with a head unit. Local monitors typically include an H2S sensor for sensing H2S gas and an audible alarm, such as a buzzer, a speaker or a horn.

DETAILED DESCRIPTION

Figure 1:
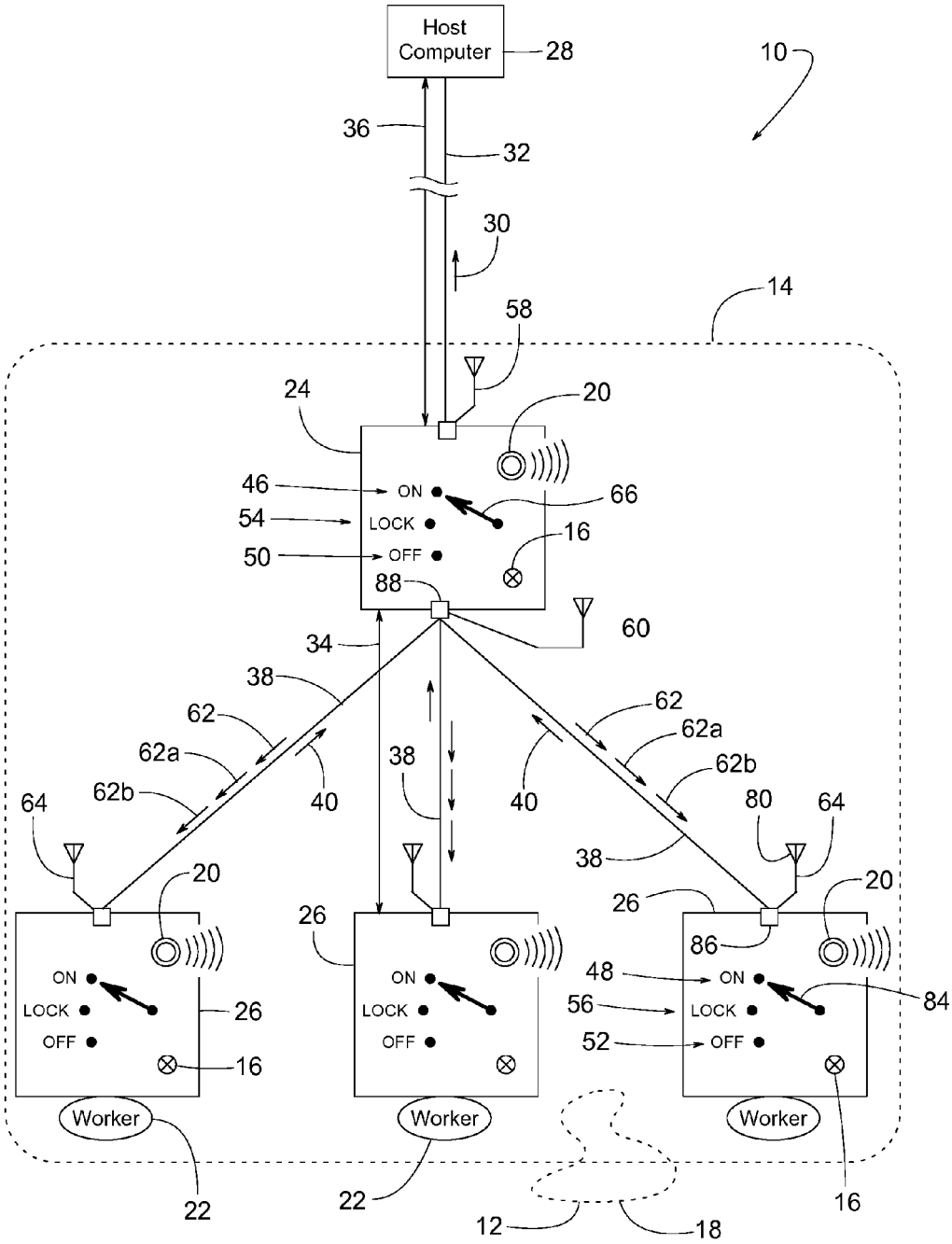
FIG. 1 is a schematic diagram of an example H2S system according to teachings disclosed herein.

FIG. 1 schematically illustrates an example H2S system 10 responsive to an H2S alarm event 12 at a worksite 14. Specifically, system 10 include one or more H2S sensors 16 for sensing the presence of hazardous levels of H2S gas 18 at worksite 14 and includes one or more audible alarms 20 (e.g., horn, buzzer, etc.) for alerting a worker 22 and others of such a hazard. The term, "worksite" means any place where a worker or another person is doing something. Examples of worksite 14 include, but are not limited to, a well site, a construction site, a sewer system, a barn, a factory, a building, open land, etc. An H2S event refers to a concentration of H2S gas 18 exceeding a predetermined safe limit.

In the example shown in FIG. 1, H2S system 10 includes a head unit 24 and at least one local monitor 26. In this example, head unit 24 and local monitor 26 are at worksite 14 for sounding alarm 20 if an H2S sensor 16 detects a predetermined high concentration of H2S gas 18. In some examples, head unit 24 wirelessly communicates H2S alarm event 12 to a host computer 28 for recording event 12 and/or for dispatching help to worksite 14. The term, "host computer" means any remote computer or computer system (e.g., desktop computer, laptop computer, server, tablet, smartphone, etc.) able to receive wireless communication such as an information signal 30 from head unit 24 via a distant wireless communication link 32. The term, "remote" means at least five miles away from worksite 14.

In some example installations, multiple local monitors 26 are distributed over worksite 14 with head unit 24 being closer to local monitors 26 than to host computer 28. In other words, a first distance 34 between head unit 24 and local monitor 26 is less than a second distance 36 between head unit 24 and host computer 28. When local monitors 26 are turned on and not locked out, local monitors 26 are in wireless communication with head unit 24 via a local wireless communication link 38. This allows local monitors 26 to convey to head unit 24 an alarm signal 40 in response to and indicative of alarm event 12. In response to receiving alarm signal 40, head unit 24 conveys information signal 30 over distant wireless communication link 32 to host computer 28, wherein information signal 30 is indicative of alarm event 12.

Figure 4:
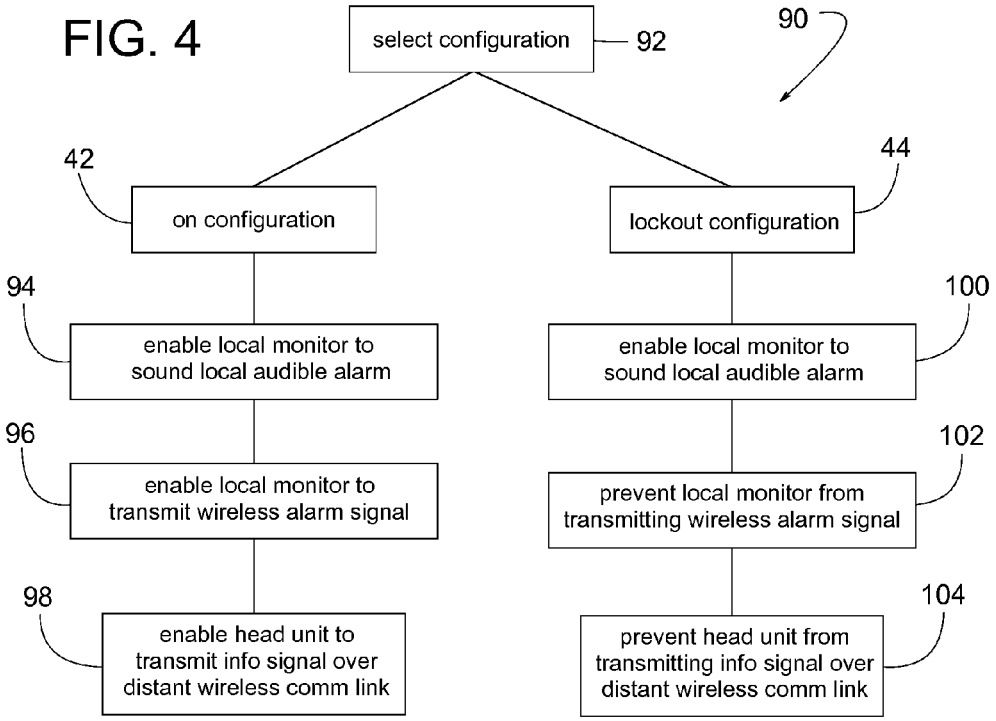
FIG. 4 is a block diagram illustrating various example methods related to the H2S system shown in FIG. 1.

In some situations, however, is might be desirable to lockout local monitors 26 and/or head unit 24 so that they do not interfere with other processes at worksite 14. For example, electronically triggered explosives might sometimes be used at a well site for perforating the casing of a wellbore. It would be dangerous, of course, if the normal operation of local monitor 26 or head unit 24 were to unexpectedly trigger an explosion. Thus, in some examples, system 10 is configurable selectively to an on configuration 42 (FIG. 4), an off configuration (neither on nor locked out), and a lockout configuration 44 (FIG. 4). In the on configuration, head unit 24 is in an on mode 46 and/or local monitor 26 is in an on state 48. In the off configuration, head unit 24 is in an off mode 50 and/or local monitor 26 is in an off state 52. In the lockout configuration, head unit 24 is in a lockout mode 54 and/or local monitor 26 is in a lockout state 56.

Head unit 24 in on mode 46, in some examples, means that head unit 24 is turned on and generally fully operational. Head unit 24 in off mode 50, in some examples, means that head unit 24 is turned off. Head unit 24 in lockout mode 54, in some examples, means that a distant emitter 58 and/or a regional emitter 60 of head unit 24 are disabled such that emitters 58 and 60 are prevented from transmitting outgoing wireless signals, such as information signal 30 or an operating signal 62. However, in some examples, audible alarm 20 and/or H2S sensor 16 of some examples of head unit 24 are still enabled and functional during lockout mode 54 so that head unit 24 can still sound its audible alarm 20 in response to the head unit's H2S sensor 16 detecting H2S alarm event 12, even though emitters 58 and/or 60 are disabled.

Local monitor 26 in on state 48, in some examples, means that local monitor 26 is turned on and generally fully operational. Local monitor 26 in off state 52, in some examples, means that local monitor 26 is turned off. Local monitor 26 in lockout state 56, in some examples, means that a local emitter 64 of local monitor 26 is disabled such that emitter 64 is prevented from transmitting outgoing wireless signals, such as alarm signal 40. However, in some examples, audible alarm 20 and H2S sensor 16 of local monitor 26 are still enabled and functional during lockout state 56 so that local monitor 26 can still sound its audible alarm 20 in response to its H2S sensor 16 detecting H2S alarm event 12, even though emitter 64 is disabled.

Figure 2:
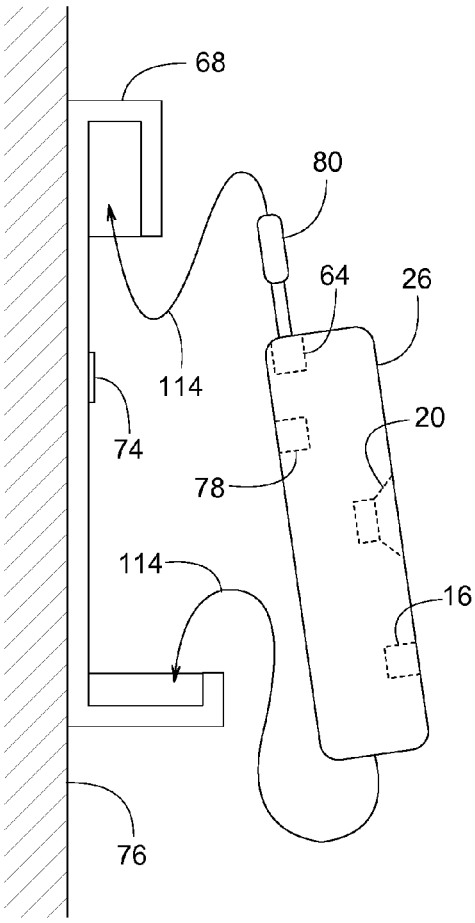
FIG. 2 is a schematic side view of an example local monitor of the H2S system shown in FIG. 1.
Figure 3:
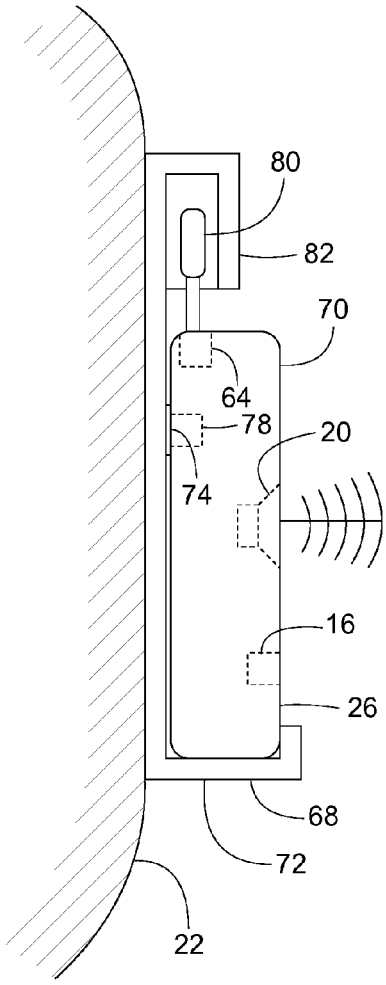
FIG. 3 is a schematic side view of the local monitor of FIG. 2 but showing the monitor connected to an example holder.

Configuring local monitor 26 to lockout state 56 and/or configuring head unit 24 to lockout mode 54 can be done in various example ways. In a first example, actuating a switch 66 configures head unit 24 to lockout mode 54, and manually connecting local monitor 26 to a holder 68, as shown in FIGS. 2 and 3, automatically switches local monitor 26 to lockout state 56. In some examples, switch 66 comprises a key for actuation (LOTO Lock-Out-Tag-Out) to prevent unauthorized persons from switching head unit 24 back to the on mode when not authorized to do so. In some examples, as shown in FIG. 3, local monitor 26 is a portable personal monitor 70 normally carried by worker 22, and holder 68 is a lockout holster 72 with a switch element 74. In some examples, as shown in FIG. 2, holder 68 is attached to a structure 76 (e.g., building, machine, post, etc.), rather than carried by worker 22. In some examples, switch element 74 is a magnet that actuates a switch circuit 78 in local monitor 26. Switch element 74 actuating switch circuit 78 changes local monitor 26 to lockout state 56. In some examples, local monitor 26 includes an antenna 80 associated with local emitter 64, and holder 68 includes a shield 82 electromagnetically obstructing antenna 80 when local monitor 26 is connected to holder 68, as shown in FIG. 3.

In a second example, actuating switch 66 configures head unit 24 to lockout mode 54, and actuating a switch 84 on local monitor 26 configures local monitor 26 to lockout state 56. To ensure that all local monitors 26 are in lockout state 56 when they should be, in some examples, head unit 24 periodically, aperiodically or continuously transmits operating signal 62 to local monitors 26 when system 10 is in the on configuration. When head unit 24 is switched to off mode 50 or to lockout mode 54, head unit 24 discontinues emitting operating signal 62. If local monitor 26 is in the on state but fails to receive operating signal 62 for a predetermined period (e.g., for one minute or several minutes), then local monitor 26 sounds alarm 20 even in absence of H2S alarm event 12, thereby notifying worker 22 and perhaps others in the vicinity that local monitor 26 has not been switched to lockout state 56 even though head unit 24 is in lockout mode 54 or in off mode 50. Subsequently manually switching local monitor 26 to lockout state 56 silences alarm 20, provided there currently is no alarm event 12.

In a third example, actuating a switch (e.g., switch 66 on head unit 24) changes head unit 24 to lockout mode 54 and causes head unit 24 to send a momentary operating signal 62*a* which, in this example, is used as a signal that head unit 24 has switched to lockout mode 54. In this example, local monitor 26 automatically switches to lockout state 56 in response to receiving operating signal 62*a*. Later, actuating switch 66 to change head unit 24 back to on mode 46 causes head unit 24 to send an operating signal 62*b*, which local monitor 26 interprets as a signal that head unit 24 has been switched back to on mode 46. In response to receiving operating signal 62*b*, local monitor 26 automatically switches back to its on state 48.

In some examples, local emitter 64 (e.g., wireless transmitter) is part of a transceiver 86 that includes local emitter 64 and a receiver portion. Local emitter 64 is for wirelessly transmitting alarm signal 40 to head unit 24, and the receiver portion is for receiving operating signals 62, 62*a* and/or 62*b*. In some examples, both local emitter 64 and the receiver portion are disabled during lockout state 56. In some examples, during lockout state 56, local emitter 64 is disabled while the receiver portion remains functional to receive operating signals 62, 62*a* and/or 62*b*.

In some examples, the head unit's regional emitter 60 (e.g., wireless transmitter) is part of a transceiver 88 that includes regional emitter 60 and a receiver portion. Regional emitter 60 is for wirelessly transmitting operating signals 62, 62*a* and/or 62*b* to local monitor 26, and its receiver portion is for receiving alarm signal 40 from local monitor 26. In some examples, both regional emitter 60 and its corresponding receiver portion are disabled during lockout mode 54. In some examples, during lockout mode 54, regional emitter 60 is disabled while its corresponding receiver portion remains functional. In some examples, the head unit's distant emitter 58 (e.g., wireless transmitter) is for wirelessly transmitting information signal 30 to host computer 28. In some examples, distant emitter 58 is disabled during lockout mode 54.

FIG. 4 shows one example H2S method 90 of using H2S system 10. Block 92 represents selecting on configuration 42 or lockout configuration 44. Block 94 represents, in the on configuration, enabling local monitor 26 to sound local audible alarm 20 in response to H2S alarm event 12. Block 96 represents, in the on configuration, enabling local monitor 26 to transmit alarm signal 40 over local wireless communication link 38 to head unit 24. Block 98 represents, in the on configuration, enabling head unit 24 to transmit information signal 30 over distant wireless communication link 32 to host computer 28, wherein information signal 30 is indicative of H2S alarm event 12.

Block 100 represents, in the lockout configuration, enabling local monitor 26 to sound local audible alarm 20 in response to H2S alarm event 12. Block 102 represents, in the lockout configuration, preventing local monitor 26 from transmitting over local wireless communication link 38 to head unit 24 even during H2S alarm event 12. Block 104 represents, in the lockout configuration, preventing head unit 24 from transmitting over distant wireless communication link 32 to host computer 28 even during H2S alarm event 12.

Figure 5:
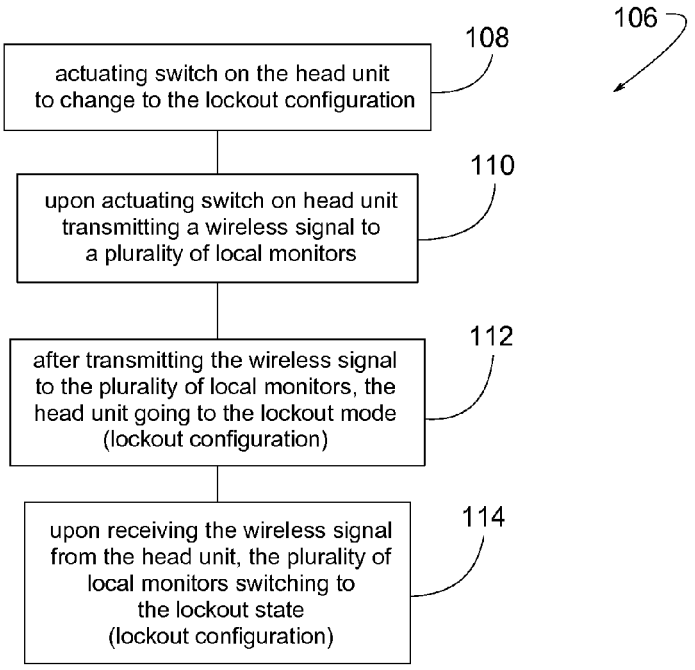
FIG. 5 is a block diagram illustrating various example methods related to the H2S system shown in FIG. 1.

In addition or alternatively, FIG. 5 shows an example H2S method 106 of using H2S system 10. Block 108 represents actuating switch 66 on head unit 24. Block 110 (FIG. 1) represents upon actuating switch 66 on head unit 24, transmitting wireless operating signal 62*a* to a plurality of local monitors 26. Block 112 represents after transmitting wireless operating signal 62*a* to the plurality of local monitors 26, head unit 24 going to lockout mode 54 (lockout configuration). Block 114 represents in response to actuating switch 66 on head unit 24, the plurality of local monitors 26 automatically switching to lockout state 56 (lockout configuration).

Figure 6:
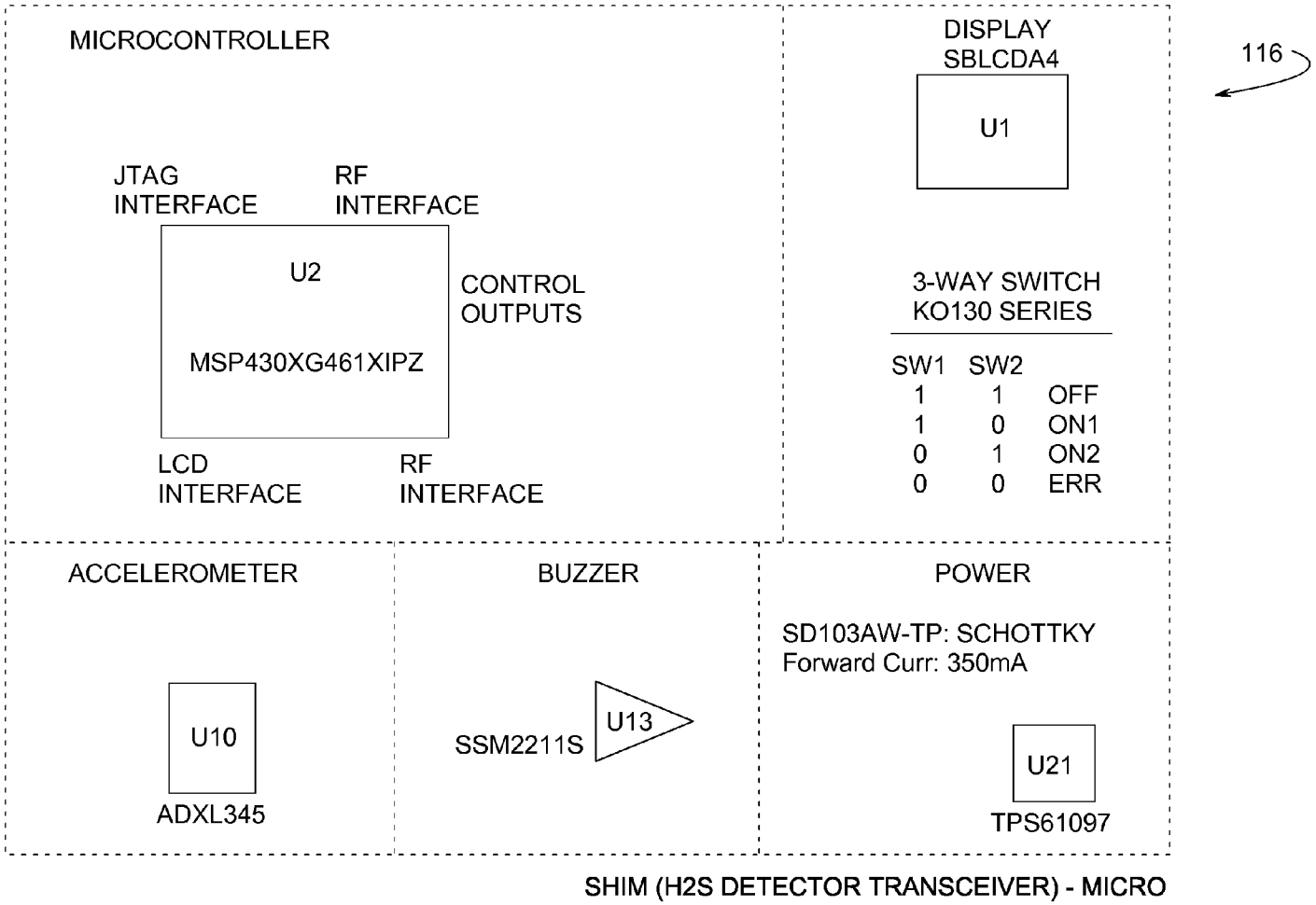
FIGS. 6 and 7 are wiring schematics of example head units and/or local units related to the H2S system shown in FIG. 1.
Figure 7:
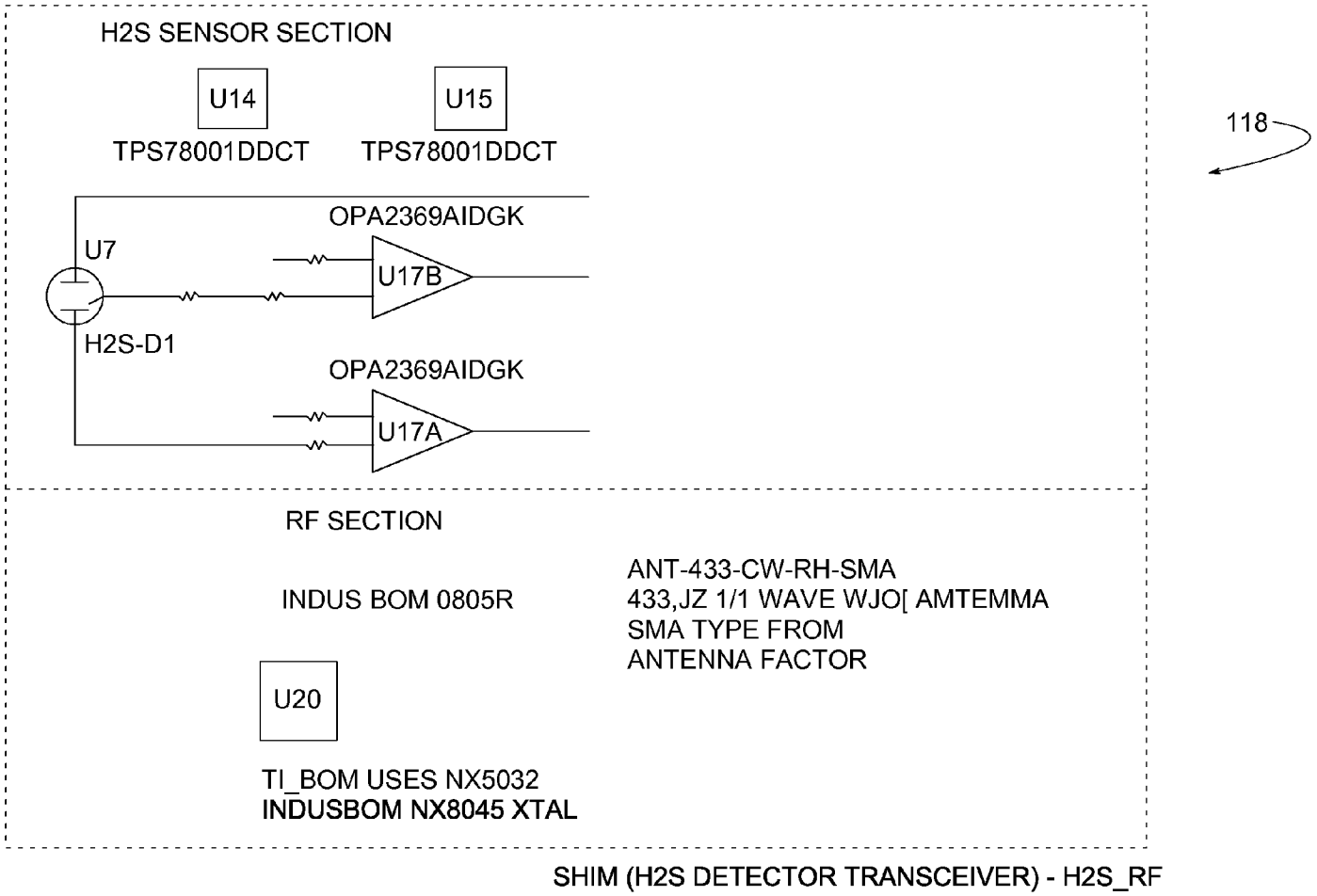

Arrows 114 of FIG. 2 represents switching from the on configuration to the lockout configuration by attaching local monitor 26 to holder 68. FIG. 3 shows worker 22 carrying local monitor 26 as a portable personal monitor 70. FIG. 3 also shows holder 68 serving as lockout holster 72. Additional details of some examples of H2S system 10 are shown in circuit diagrams 116 and 118, which are illustrated in FIGS. 6 and 7, respectively.

Although the invention is described with respect to a preferred embodiment, modifications thereto will be apparent to those of ordinary skill in the art. The scope of the invention, therefore, is to be determined by reference to the following claims:

The invention claimed is:

1. An H2S system for protecting a worker at a worksite by responding to an H2S alarm event at the worksite, the H2S alarm event being a concentration of H2S gas exceeding a predetermined safe limit, the H2S system comprising:

a holder;

a local monitor responsive to the H2S alarm event, the local monitor having selectively an on state and a lockout state, the local monitor being automatically switched from the on state to the lockout state in response to being connected to the holder, the on state and the lockout state are as follows:

in the on state, the local monitor sounds a local audible alarm in response to the H2S alarm event;

in the on state, the local monitor emits an alarm signal over a local wireless communication link in response to the H2S alarm event;

in the lockout state, the local monitor sounds the local audible alarm in response to the H2S alarm event; and in the lockout state, the local monitor is inhibited from emitting the alarm signal over the local wireless communication link in response to the H2S alarm event.

2. The H2S system of claim 1, wherein the local monitor is a portable personal monitor carried by the worker.

3. The H2S system of claim 1, wherein the holder includes a magnet triggering the local monitor to the lockout state when the local monitor is connected to the holder.

4. The H2S system of claim 3, wherein the local monitor includes an antenna, and the holder includes a shield electromagnetically obstructing the antenna when the local monitor is connected to the holder.

5. An H2S system for protecting a worker at a worksite by responding to an H2S alarm event at the worksite, the H2S alarm event being a concentration of H2S gas exceeding a predetermined safe limit, the H2S system comprising:

a host computer being remote relative to the worksite;

a head unit including a distant emitter being at the worksite, the head unit having an on mode, an off mode, and a lockout mode, the distant emitter being selectively enabled and disabled;

a local monitor at the worksite, the local monitor comprising an H2S sensor, a local emitter, and a local audible alarm, the local monitor having an on state, an off state, and a lockout state, the local emitter being selectively enabled and disabled, the local monitor being spaced apart from the head unit a first distance, the host computer being spaced apart from the head unit a second distance, the second distance being greater than the first distance;

a local wireless communication link between the local monitor and the head unit;

an alarm signal conveyed at times from the local emitter to the head unit via the local wireless communication link, the alarm signal being indicative of the H2S alarm event;

a distant wireless communication link between the head unit and the host computer; and an information signal conveyed at times from the distant emitter of the head unit to the host computer via the distant wireless communication link, the information signal being indicative of the H2S alarm event, the H2S system being selectively configured as follows:

a) in the on state and in the lockout state, the local audible alarm sounds in response to the H2S sensor sensing the concentration of H2S gas has exceeded the predetermined safe limit;

b) in the lockout state, the local emitter is disabled, yet the local audible alarm remains enabled for sounding off in response to the concentration of H2S gas exceeding the predetermined safe limit;

c) in the off state, the local audible alarm and the local emitter are disabled;

d) in the lockout mode, the distant emitter of the head unit is disabled;

e) in the on mode, the distant emitter of the head unit is enabled for wireless transmission; and f) in the off mode, the distant emitter of the head unit is disabled.

6. The H2S system of claim 5, wherein the head unit further comprises a regional emitter connected in wireless communication with the local monitor, the regional emitter being disabled when the head unit is in the lockout mode, the regional emitter being enabled when the head unit is in the on mode, and the regional emitter being disabled when the head unit is in the off mode.

7. The H2S system of claim 6, further comprising an operating signal conveyed at times from the regional emitter of the head unit to the local monitor, the operating signal being indicative of the head unit being in the on mode, a predefined absence of the operating signal being indicative of the head unit being in at least one of the off mode and the lockout mode.

8. The H2S system of claim 5, wherein the local monitor is a portable personal monitor carried by the worker.

9. The H2S system of claim 8, wherein the holster includes a magnet triggering the portable personal monitor to the lockout state when the portable personal monitor is connected to the holster.

10. The H2S system of claim 8, wherein the portable personal monitor includes an antenna associated with the local emitter, and the lockout holster includes a shield electromagnetically obstructing the antenna when the portable personal monitor is connected to the lockout holster.

11. The H2S system of claim 5, further comprising a lockout holster to which the local monitor is selectively connected and disconnected, the local monitor being in the lockout state in response to the local monitor being connected to the lockout holster.

12. The H2S system of claim 5, wherein the local audible alarm sounds off at times in absence of the H2S alarm event when the head unit is in the lockout mode while the local monitor is in the on state and not in the lockout state.

13. The H2S system of claim 5, wherein head unit further comprises a central audible alarm that sounds in response to the head unit receiving the alarm signal from the local monitor.

14. An H2S method for protecting a worker at a worksite by responding to an H2S alarm event at the worksite, the H2S alarm event being a concentration of H2S gas exceeding a predetermined safe limit, the H2S method involving the use of at least one of a head unit at the worksite, a local monitor at the worksite and a host computer beyond the worksite, the H2S method being usable selectively in an on configuration and a lockout configuration, the H2S method comprising:

in the on configuration, enabling the local monitor to sound a local audible alarm in response to the H2S alarm event;

in the on configuration, enabling the local monitor to transmit an alarm signal over a local wireless communication link to the head unit;

in the lockout configuration, enabling the local monitor to sound the local audible alarm in response to the H2S alarm event; and in the lockout configuration, preventing the local monitor from transmitting over the local wireless communication link to the head unit even during the H2S alarm event.

15. The H2S method of claim 14, further comprising:

in the on configuration, enabling the head unit to transmit an information signal over a distant wireless communication link to the host computer, wherein the information signal is indicative of the H2S alarm event, and the head unit is closer to the local monitor than to the host computer; and in the lockout configuration, preventing the head unit from transmitting over the distant wireless communication link to the host computer even during the H2S alarm event.

16. The H2S method of claim 14, further comprising:

providing a plurality of local monitors that includes the local monitor;

actuating a switch on the head unit; and in response to actuating the switch on the head unit, the plurality of local monitors automatically switching to the lockout configuration.

17. The H2S method of claim 14, further comprising switching from the on configuration to the lockout configuration by attaching the local monitor to a holder.

18. The H2S method of claim 17, further comprising the worker carrying the local monitor as a portable personal monitor, and the holder is a lockout holster.

* * * * *